US005495890A

United States Patent [19]

Edwards et al.

[11] Patent Number: 5,495,890

[45] **Date of Patent: * Mar. 5, 1996**

[54] FLOAT OPERATED PNEUMATIC PUMP

[75] Inventors: David H. Edwards, Ann Arbor; Kevin L. Newcomer, Monroe; K. Lynn Niehaus, Manchester, all of Mich.

[73] Assignee: QED Environmental Systems, Inc., Ann Arbor, Mich.

[ * ] Notice: The portion of the term of this patent subsequent to Oct. 25, 2011, has been disclaimed.

[21] Appl. No.: 325,699

[22] Filed: Oct. 19, 1994

Related U.S. Application Data

[63] Continuation of Ser. No. 116,288, Sep. 3, 1993, Pat. No. 5,358,038, which is a continuation-in-part of Ser. No. 38,835, Mar. 29, 1993, Pat. No. 5,358,037.

[51] Int. Cl.[6] ..... E21B 43/00; E21B 1/06

[52] U.S. Cl. ..... 166/105; 417/131; 417/126

[58] Field of Search ..... 166/105, 107; 417/86, 90, 116, 126, 131, 138

[56] References Cited

U.S. PATENT DOCUMENTS

| | | |
|---|---|---|
| 2,141,261 | 12/1938 | Clark . |
| 2,606,500 | 8/1952 | Schmidt . |
| 3,007,416 | 11/1961 | Childs . |
| 3,039,309 | 6/1962 | Vesper et al. . |
| 3,048,121 | 8/1962 | Sheesley . |
| 3,074,351 | 1/1963 | Foster . |
| 3,148,624 | 9/1964 | Baldwin . |
| 3,154,021 | 10/1964 | Vick, Jr. . |
| 3,173,372 | 3/1965 | Baldwin . |
| 3,175,498 | 3/1965 | Rohrer . |
| 3,194,170 | 7/1965 | Ulbing . |
| 3,298,320 | 1/1967 | Latham, Jr. . |
| 3,647,319 | 3/1972 | McLean et al. . |
| 3,677,667 | 7/1972 | Morrison . |
| 3,724,973 | 4/1973 | Shill . |
| 3,816,032 | 6/1974 | Flynn et al. . |
| 3,949,753 | 4/1976 | Dockhorn . |
| 3,983,857 | 10/1976 | O'Connor . |
| 3,987,775 | 10/1976 | O'Connor . |
| 4,020,978 | 5/1977 | Szczepanski . |
| 4,030,640 | 6/1977 | Citrin et al. . |
| 4,104,005 | 8/1978 | Poirier . |
| 4,184,811 | 1/1980 | Schade . |
| 4,257,751 | 3/1981 | Kofahl . |
| 4,295,801 | 10/1981 | Bennett . |
| 4,438,654 | 3/1984 | Torstensson . |
| 4,489,779 | 12/1984 | Dickinson et al. . |
| 4,580,952 | 4/1986 | Eberle . |

(List continued on next page.)

FOREIGN PATENT DOCUMENTS

| | | |
|---|---|---|
| 21044135 | 5/1985 | United Kingdom . |

*Primary Examiner*—Frank S. Tsay
*Attorney, Agent, or Firm*—Harness, Dickey & Pierce

[57] ABSTRACT

A float operated, top fill, recovery unit floats in a body of contaminated groundwater to recover a layer of liquid hydrocarbons residing on top of the groundwater. The recovery unit has an upper end fitted with a discharge check valve assembly and a lower end that is closed, the discharge valve assembly including a semi-permeable screen which is positioned in and skims the liquid hydrocarbons, and a series of passages and check valves for directing the hydrocarbons via a return line to a holding tank. In an embodiment disclosed, the lower end of the unit is formed in part by an inlet check valve arrangement which has had its check ball removed such that the arrangement does not operate to inhibit flow, and a closure plate is secured to the inlet valve arrangement to prevent external fluid from entering the unit. Sinking of the recovery unit allows hydrocarbons to pass through the screen to fill the interior of the unit so that it can be pumped out of the unit by compressed air and conveyed to the holding tank. The top fill recovery unit is easily modified to a bottom fill underground contaminated water recovery unit by removing the closure plate and replacing the check ball in the inlet valve arrangement, removing the top discharge valve assembly, and connecting the return line directly to the top of the unit.

18 Claims, 6 Drawing Sheets

U.S. PATENT DOCUMENTS 4,585,060 4/1986 Bernardin et al. .
4,669,554 6/1987 Cordry .
4,701,107 10/1987 Dickinson et al. .
4,727,936 3/1988 Mioduszewski et al. .
4,807,707 2/1989 Handley et al. .
4,886,432 12/1989 Kimberlin .
4,998,585 3/1991 Newcomer et al. .
5,004,405 4/1991 Breslin .
5,141,404 8/1992 Newcomer et al. .
5,147,185 9/1992 Niehaus et al. .

FLOAT OPERATED PNEUMATIC PUMP

This a continuation of U.S. patent application Ser. No. 08/116,288, filed Sep. 3, 1993, now U.S. Pat. No. 5,358,038 which is a continuation-in-part application of Ser. No. 08/038,835, filed Mar. 29, 1993, now U.S. Pat. No. 5,358,037.

FIELD OF THE INVENTION

This invention relates generally to underground fluid pumping recovery systems which are self-activating in response to surrounding liquid levels. The invention has particular application to a top fill recovery unit which is intended to recover a layer of liquid hydrocarbons (e.g., gasoline or oil) which contaminate the top of groundwater and which is modifiable into a bottom fill recovery unit to recover contaminated groundwater.

BACKGROUND OF THE INVENTION

Increased monitoring of environmental quality has resulted in a substantial rise in the number of identified sites of contaminated ground water. Accompanying this trend has been an increased effort to clean up these sites. In response, there is a need for improved below ground pumping systems to assist in these clean up efforts.

Ideally, below ground pumping systems used for these purposes will have a number of desired characteristics. Because of the large number of pumping systems required, it is desirable to minimize the cost of each pump and each installation. Accordingly, such pumps should be relatively simple and inexpensive and should fit in a small diameter well due to the increased cost of drilling large diameter wells. To minimize maintenance and repair costs, the pumps should have a minimum of moving parts and should have high reliability. Also, such pumps should be able to withstand corrosive fluid streams without failure.

Due to the possibility of exposure of the pumping systems to explosive gasses, pneumatic pumps are preferred over electrical pumps for pumping waste products. However, many of the currently used pneumatic pumps have a number of drawbacks. For example, many pumps in current use require external controlling devices which use timers to activate the pump on a fixed schedule. This necessity of external controllers adds considerably to the cost and complexity of the overall pumping system. In addition, the use of a fixed time pumping schedule has disadvantages since it may not result in pumping at the most opportune time to obtain the maximum production from the pump. For example, an external timer cannot sense variations in the flow rate of fluid into the pump and thus may result in either a too fast or a too slow pumping cycle.

There are pumps which avoid the necessity of external controllers by incorporating sensing means within the pump to detect when fluid has entered the pump to a desired level. Unfortunately, the prior art pumps which are capable of self activation have not proved satisfactory in many applications. One problem has been with the mechanical actuating and sensing mechanism within the pumps. Generally, such pumps use a float which rises when the pumps fills and lowers when the pump is empty. Actuating mechanisms which sense the movement of this float sometimes require considerable force to switch the pumps pneumatic valve on and off. This results in the necessity of a fairly large and heavy float which increases the overall size and cost of the pump system.

In addition to the problems with the actuating mechanism, the pneumatic valve used to control the flow of compressed air into these pumps have often proved unreliable. Spool type valves incorporating sliding seals are generally used in prior art pumps of this nature. The force necessary to move these sliding seals to actuate spool type valves are one source of the excess actuating force requiring the above mentioned large and heavy floats. In addition, spool type valves result in high maintenance and repair costs due to their tendency to freeze or to leak. There are a number of causes of the difficulties with sliding seals. These include debris entering the seals from the source of compressed air; contamination of the seals from the liquid being pumped (especially where highly corrosive waste products are pumped); loss of lubrication in the seals; and compression set of the elastomeric seals if they remain inactive for an extended period of time. In addition, some prior art pumps employ valves which have a significant cross over point where air supply is partially open and air exhaust is partially closed. At this point, the pump will tend to use a large amount of compressed air in an effort to switch to a fully open or a fully closed position. In some cases, the pump may reach a steady state condition with the head pressure in the surrounding well causing the pump to remain in a cross over, or all ports open, position.

Another difficulty with sliding seals results from their use to provide a detent action between the discharge and refill cycles of the valve. As the sliding seals wear, the ability of these sliding seals to provide a detent action will be lost. The sliding seals are normally comprised of O-rings and the wear of these O-rings will result in short and erratic pump cycles unless the O-rings are replaced. Thus, it would be desirable to provide an underground pumping system which overcomes some or all of the above mentioned difficulties.

Accordingly, it is an object of the present invention to provide a simple and inexpensive pumping system for installing in small diameter wells. It is a further object of the present invention to provide such a pumping system which is reliable, has a limited number of moving parts and which provides automatic on/off level control to eliminate the need for external controllers.

It is an additional object of the present invention to provide an underground pumping system which uses a pneumatic valve that avoids the use of sliding seals and which is switched between pumping and discharge cycles with a minimum of actuation force and without experiencing cross over. It is a further object for the present invention to provide such a pumping system having a reliable and durable detent between pump discharge and refill cycles.

A further object of this invention is provision of top fill, substantially fully automatic, recovery unit for collecting and pumping liquid hydrocarbons residing on the top of groundwater below ground level. A related object is provision of a pumping system that includes a recovery unit for top entry and top discharge of liquid hydrocarbons and which can be converted into a recovery unit for bottom entry and top discharge of groundwater contaminants.

SUMMARY OF THE INVENTION

A float operated, top fill, recovery unit floats in a body of contaminated groundwater below ground level to recover a layer of liquid hydrocarbons residing on top of the groundwater. The recovery unit has an upper end fitted with a discharge check valve assembly and a lower end that is closed, the discharge valve assembly including a semi-permeable screen which is positioned in and skims the liquid hydrocarbons, and a series of passages and check valves for directing the hydrocarbons via a return line to a remote holding tank. In an embodiment disclosed, the lower end of the unit is formed in part by an inlet check valve arrangement which has had its check ball removed such that the arrangement permits flow and does not operate as a valve to inhibit flow, and a closure plate is secured to the inlet valve arrangement to prevent external fluid from entering the bottom of the unit. Sinking of the recovery unit allows hydrocarbons to pass through the screen to fill the interior of the unit so that it can be pumped out of the unit by compressed air and conveyed to the holding tank.

The top fill recovery unit is easily modified to a bottom fill underground contaminated water recovery unit by removing the closure plate and replacing the check ball in the inlet valve arrangement, removing the top discharge valve assembly, and connecting the return line directly to the top of the unit.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
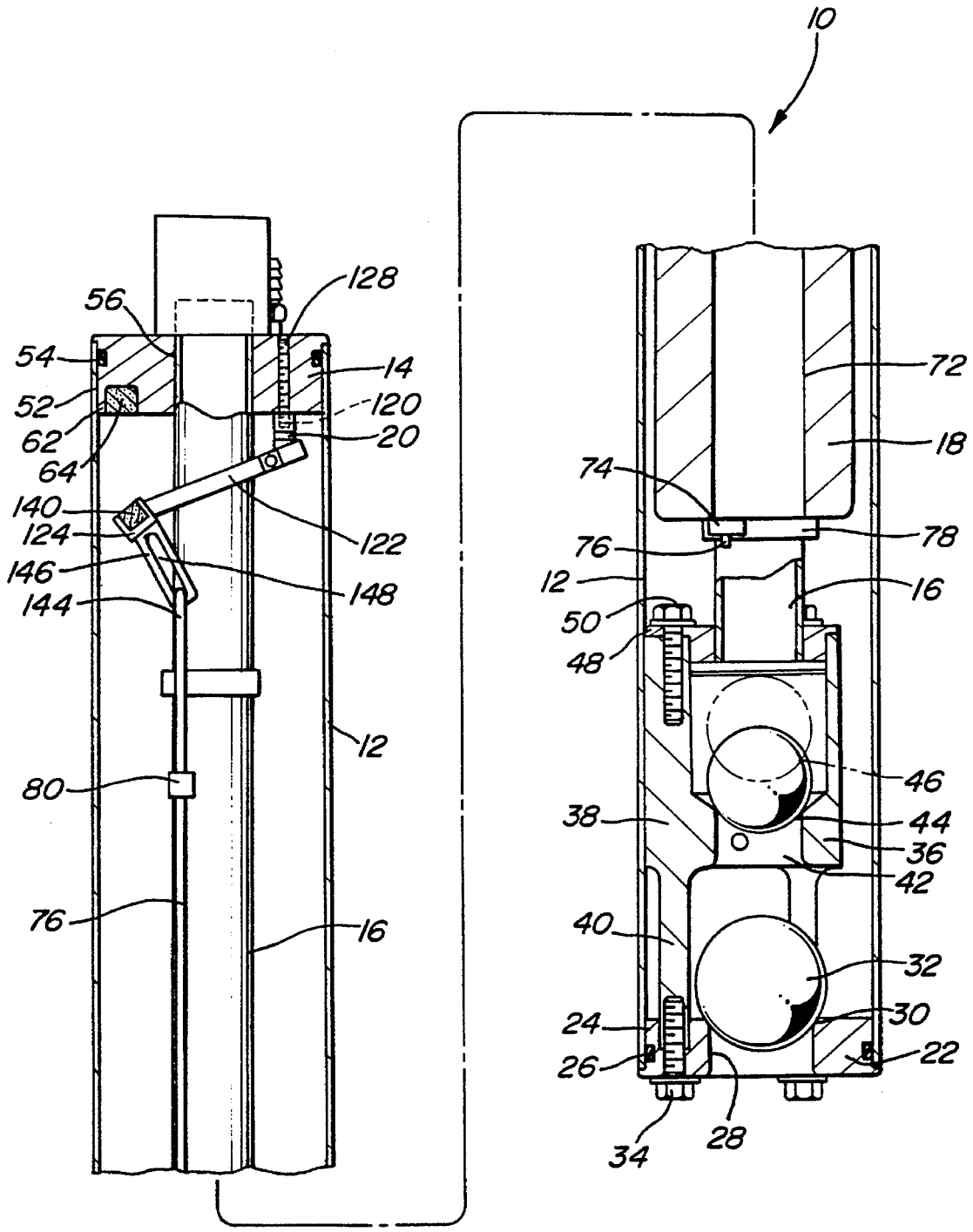
FIG. 1 is a longitudinal cross-sectional view of the pumping system in accordance with the present invention shown in the refill cycle.

Referring now to the drawings in which like reference numerals designate like or corresponding parts throughout the several views, there is shown in FIGS. 1 through 5 a pumping system 10 in accordance with the present invention. Pumping system 10 comprises a hollow pump body 12, a discharge housing 14, a dip tube 16, a float 18 and an activation mechanism 20.

Pump body 12 is a cylindrical hollow tube preferably composed of a rigid material not susceptible to corrosion, such as stainless steel. Pump body 12 is closed at its lower end by an end cap check valve 22 which is inserted into the lower end of pump body 12. End cap check valve 22 has a reduced diameter section 24 for insertion into pump body 12 and includes a seal 26 to form a liquid tight seal between end cap check valve 22 and pump body 12. End cap check valve 22 includes an inlet port 28 which extends through end cap check valve 22 and defines a valve seat 30 which mates with a check ball 32 to form a check valve which will allow fluid flow from the area around pumping system 10 (the interior of the well within which pumping system 10 is inserted) to the interior of pump body 12 but fluid flow in the opposite direction is prohibited.

Secured to the top of end cap check valve 22 by a plurality of bolts 34 is a backflow discharge check valve 36. Backflow discharge check valve 36 includes a housing 38 having a plurality of legs 40 extending from it. The plurality of legs 40 space housing 38 away from end cap check valve 22 and provide the necessary room for check ball 32 to operate. The plurality of legs 40 also operate to form a cage which encapsulates check ball 32 while still permitting fluid flow through inlet port 28 into pump body 12. Housing 38 defines an outlet port 42 which extends through housing 38 and defines a valve seat 44 which mates with a check ball 46 to form check valve 36 which will allow fluid flow from the interior of pump body 12 through dip tube 16 but fluid flow in the opposite direction is prohibited. A cap 48 is secured to the top of housing 38 by a plurality of bolts 50 and operates to retain check ball 46 within housing 38 as well as providing for the attachment of dip tube 16 as will be described later herein.

At the opposite end of pump body 12 is discharge housing 14 which has a reduced diameter portion 52 for inserting it into pump body 12. A seal 54 forms a liquid and air tight seal with pump body 12. Discharge housing 14 includes a liquid discharge port 56 which extends through discharge housing 14 and is adapted for mating with dip tube 16 as will be described later herein. Discharge housing 14 further includes an air inlet port 58, an air discharge port 60 and a bore 62 for locating a first actuating magnet 64. Air inlet port 58 is adapted to receive an air inlet valve 66 and air discharge port 60 is adapted to receive an air discharge valve 68 as will be described later herein.

Dip tube 16 extends from discharge port 56 of discharge housing 14 to cap 48 of housing 38. Dip tube 16 is sealingly secured to both discharge housing 14 and cap 48 by welding or other means known well in the art. Dip tube 16 provides a path for the fluid within pump body 12 to flow out of pump body 12 through diptube 16 and through discharge port 56. Discharge port 56 is in communication with both dip tube 16 and a discharge tube (not shown) for transporting the pumped fluid to the surface.

Float 18 is disposed within the interior of pump body 12 and defines an axial bore 72 into which dip tube 16 is inserted. There is sufficient clearance between axial bore 72 and the exterior of dip tube 16 to permit float 18 to freely move up and down along dip tube 16. Float 18 further defines a second axial bore (not shown) into which an actuating rod 76 is inserted. Actuating rod 76 is positioned parallel to dip tube 16 and there is sufficient clearance between the second axial bore in the float 18 and the exterior of actuating rod 76 to permit float 18 to freely move up and down along actuating rod 76. A lower stop 78 is fixedly secured to dip tube 16 and is positioned towards the lower end of actuating rod 76 to limit the downward movement of float 18. A second lower stop 74 is fixedly secured to actuating rod 76 and is positioned towards the lower end of actuating rod 76 in order for the weight of float 18 to be able to deactivate the pumping of the pumping system 10. An upper stop 80 is fixedly secured to actuating rod 76 and is positioned towards the upper end of actuating rod 76 to limit the upward movement of float 18. Float 18 is less dense than the liquid to be pumped and thus provides sufficient lifting action when pump body 12 is filled with fluid to activate pumping system 10 as will be explained later herein. Float 18 also provides sufficient weight to de-activate the pumping of the pumping system 10 as will also be explained later herein.

Air inlet valve 66 has a generally cylindrical shaped housing 82 defining an external surface 84 and an internal surface 86. External surface 84 is adapted to mate with air inlet port 58 within discharge housing 14. An annular groove 88 is defined by external surface 84 and receives a seal 90 for sealing the connection between discharge housing 14 and air inlet valve 66. Once adjusted to the proper location, air inlet valve 66 is fixedly secured in position by a set screw 92. Internal surface 86 defines a threaded end 94 for connection to a tube (not shown) which supplies the compressed air to the pumping system 10 for activation. The end of internal surface 86 opposite to threaded end 94 forms an inlet valve seat 96. A ball 98 is positioned between threaded end 94 and valve seat 96. Ball 98 cooperates with valve seat 96 to connect and disconnect the compressed air being supplied to air inlet valve 66 with the interior of pump body 12. A retaining ring 100 is provided to maintain ball 98 within air inlet valve 66. While air inlet valve 66 has been shown and described as being a separate component secured within inlet port 58, it is within the scope of the present invention to have inlet valve 66 machined as an integral part of discharge housing 14.

Air discharge valve 68 has a generally cylindrical shaped housing 102 defining an external surface 104 and an internal surface 106. External surface 104 is adapted to mate with air discharge port 60 within discharge housing 14. An annular groove 108 is defined by external surface 104 and receives a seal 110 for sealing the connection between discharge housing 14 and air discharge valve 68. Once adjusted to the proper position, air discharge valve 68 is fixedly secured in position by set screw 112. Internal surface 106 defines a threaded end 114 for connection to a tube (not shown) which vents the interior of pump body 12 to the atmosphere. The end of internal surface 106 opposite to threaded end 114 forms an outlet valve seat 116. Outlet valve seat 116 is faced away from threaded end 114 and is adapted to mate with a spring loaded check ball 118 which is secured to activation mechanism 20. Check ball 118 cooperates with valve seat 116 to connect and disconnect the interior of pump body 12 with the outside atmosphere. While air discharge valve 68 has been shown and described as being a separate component secured within air discharge port 60, it is within the scope of the present invention to have air discharge valve 68 machined as an integral part of discharge housing 14.

Figure 2:
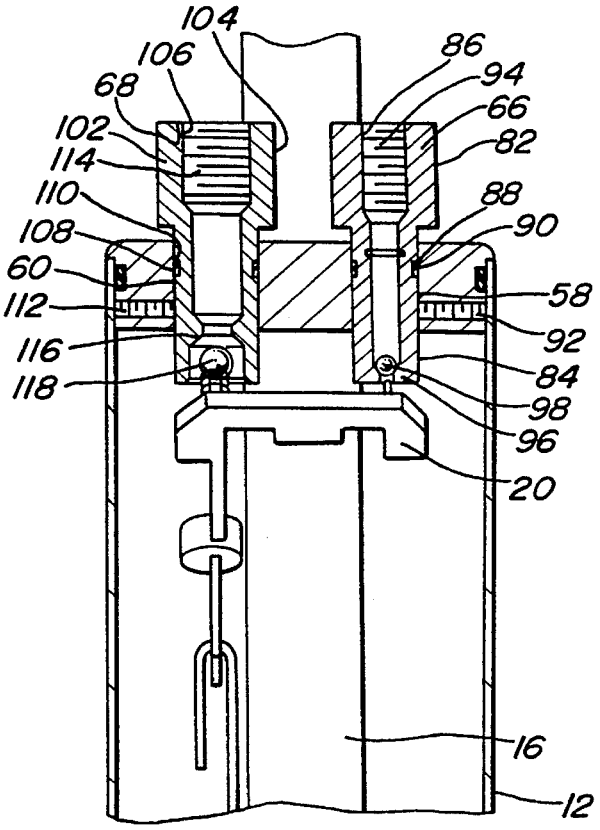
FIG. 2 is an enlarged cross-sectional view of the inlet and exhaust valves of the pumping system shown in FIG. 1 in the refill mode.
Figure 4:
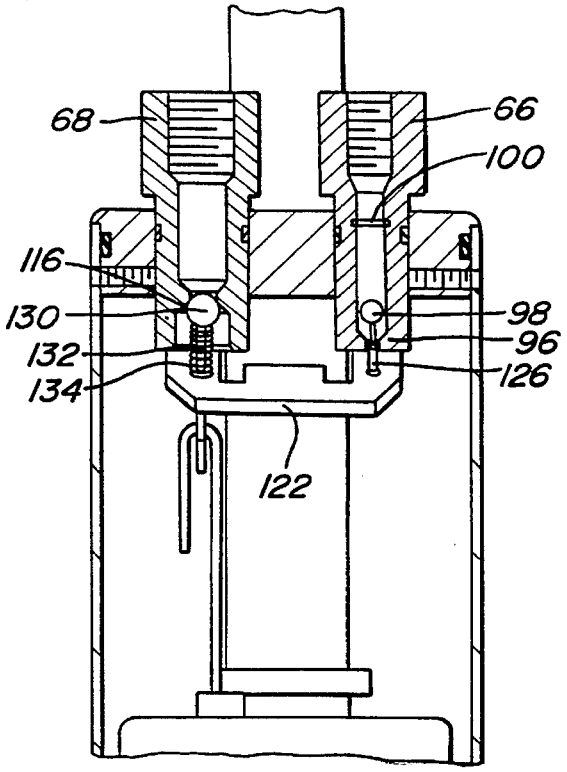
FIG. 4 is an enlarged cross-sectional view of the inlet and exhaust valves of the pumping system shown in FIG. 3 in the discharge mode.
Figure 3:
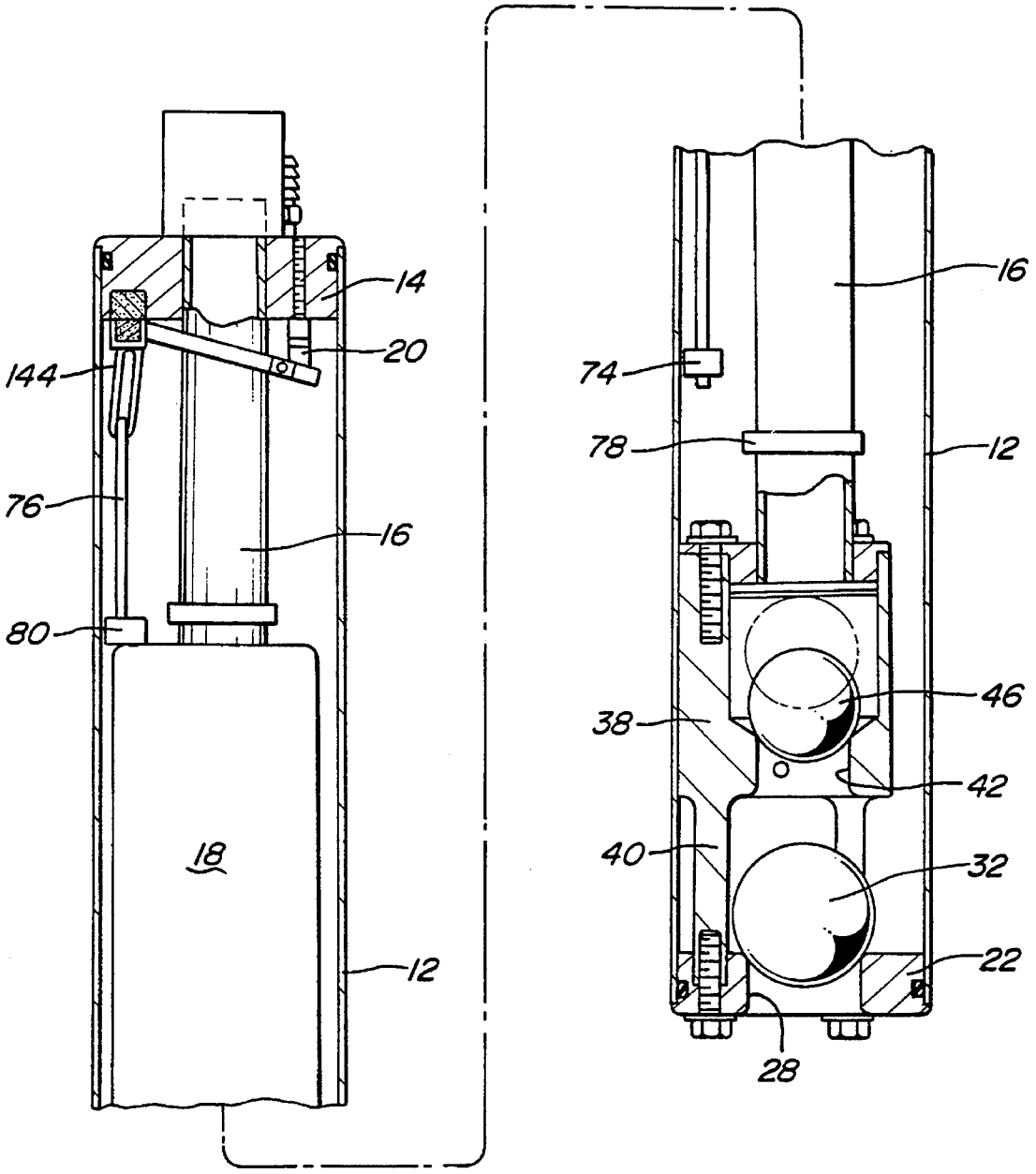
FIG. 3 is a longitudinal cross-sectional view of the pumping system in accordance with the present invention in the discharge cycle.
Figure 5:
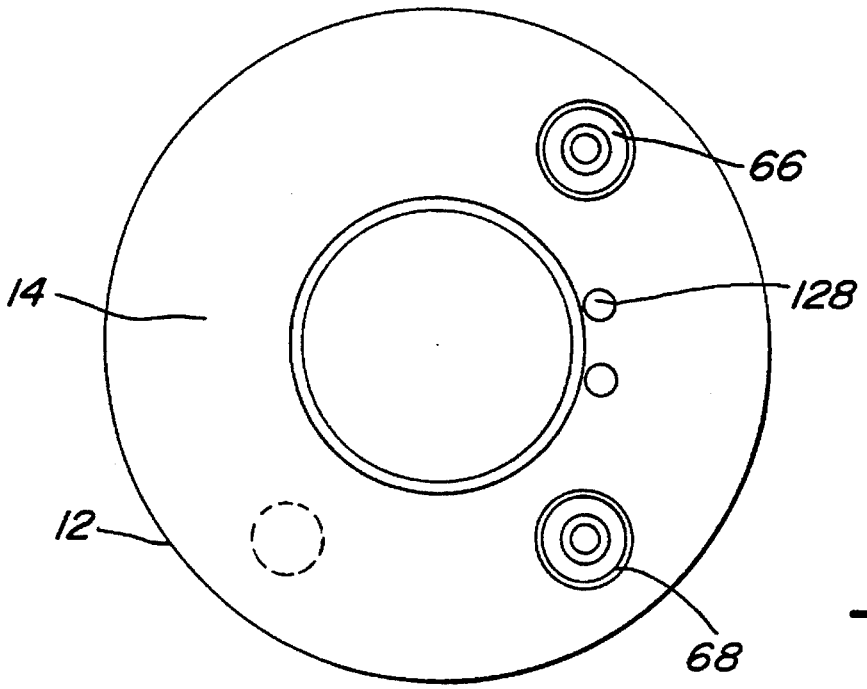
FIG. 5 is a top view of the pumping system shown in FIG. 6 showing the relative location of the connection to the pumping system.

Activation mechanism 20 comprises a bracket 120, an activation arm 122 and a magnet holder 124. Bracket 120 is fixedly secured to discharge housing 14 by a plurality of bolts 128. Pivotally attached to bracket 120 is activation arm 122. Activation arm 122 is a generally U-shaped arm which partially encircles dip tube 16. Activation arm 122 is adapted along the length of the two leg sections for mounting check ball 118 of air discharge valve 68, for mounting an activation pin 126 for activating air inlet valve 66 and for locating magnet holder 124. Activation pin 126 is mounted to one leg of activation arm 122. Activation pin 126 is mounted to one leg of activation arm 122 such that activation pin 126 contacts ball 98 and lifts ball 98 off of inlet valve seat 96 opening air inlet valve 66 when activation arm 122 is pivoted upward as shown in FIG. 4. When activation arm 122 is pivoted downward as shown in FIG. 2, ball 98 is again free to locate in inlet valve seat 96 thus closing air inlet valve 66. Check ball 118 comprises a spherical head 130 and a cylindrical stem 132. Cylindrical stem 132 is inserted through a hole in one of the legs of activation arm 122 opposite to the leg which mounts activation pin 126 and is secured to activation arm 122 by means known well in the art such that spherical head 130 is allowed to move perpendicular with respect to activation arm 122. A coil spring 134 biases spherical head 130 away from activation arm 122. Upon upward movement of activation arm 122 as shown in FIG. 4, spherical head 130 engages outlet valve seat 116 and closes air discharge valve 68. When activation arm 122 is pivoted downward as shown in FIG. 2, spherical head 130 is disengaged from outlet valve seat 116 and air discharge valve 68 is open. The spring action of check ball 118 permits closing of air discharge valve 68 before the opening of air inlet valve 66 thereby eliminating any cross over as well as taking up any wear between spherical head 130 and valve seat 116. During assembly of the pumping system 10, air inlet valve 66 and air discharge valve 68 are inserted into discharge housing 14 and adjusted such that spherical head 130 contacts outlet valve seat 116 at the same time or just prior to activation pin 126 contacting ball 98. This adjustment insures elimination of any cross over. Once adjusted, air inlet valve 66 and air discharge valve 68 are secured in place by set screws 92 and 112 respectively.

Magnet holder 124 is attached to the open and of one of the legs of activation arm 122. Magnet holder 124 receives a second actuating magnet 140. The lower end of magnet holder 124, or the end opposite to magnet 140, is attached to an actuator linkage or lost motion device 144. Magnet 140 is adapted to mate with magnet 64 to keep activation arm 122 in an upward position thus maintaining the discharge mode of the pumping system 10 until the weight of float 18 acts to separate the two magnets and switch the pumping system 10 into the refill mode. Actuator linkage 144 makes the connection between magnet holder 124 of activation mechanism 20 and float 18. Actuator linkage 144 comprises a bracket 146 which is fixedly attached to the lower end of magnet holder 124 and has a longitudinally extending slot 148. Actuating rod 76 has a U-shaped bend in the upper end thereof such that actuating rod 76 extends through slot 148 of bracket 146. Linkage 144 allows relative movement between actuating rod 76 and activation mechanism 20 to allow for the movement of activation arm 122 due to the mutual attraction of magnets 64 and 140 as will be described later herein.

The operation of the pumping system 10 begins with the insertion of the pumping system 10 within a well (not shown). Appropriate connecting tubes (not shown) attach air inlet valve 66 to a source of compressed air, air discharge valve 68 to the outside atmosphere and discharge housing 14 to a discharge line. Upon insertion into the well, the pumping system 10 is in the refill mode as shown in FIGS. 1 and 2. Fluid from the well enters the interior of pump body 12 through end cap check valve 22. This refill mode continues due to the hydrostatic effect of the fluid within the well and continues to fill pump body 12 which causes float 18 to begin to rise.

Float 18 continues to rise until contact is made with upper stop 80 on actuating rod 76. This contact with the upper stop 80 begins to move actuating rod 76 upward until stop 80 contacts bracket 146. Continued upward movement of float 18 will then begin to pivot actuation arm 122. As activation arm 122 continues to pivot, spherical head 130 of check ball 118 of air discharge exhaust valve 68 will come into contact with outlet valve seat 116 closing air discharge valve 68. At the same time or shortly after spherical head 130 contacts outlet valve seat 116, activation pin 126 of activation mechanism 20 contacts ball 98 lifting ball 98 off of inlet valve seat 96 and providing compressed air into the interior of pump body 12. The spring mounting of spherical head 130 and the cylindrical stem 132 permit continued pivotal movement of activation arm 122 after spherical head 130 contacts outlet valve seat 116. In addition, the lever arm effect of activation arm 122 significantly increases the load exerted by the buoyancy of float 18 thus insuring the sealing of air discharge valve 68. Once activation arm 122 reaches this position, magnet 140 and magnet 64 are mutually attracted causing a magnetic locking which holds activation arm 122 in the upward position. Magnets 140 and 64 are allowed to snap together due to the movement of bracket 146 with respect to actuating rod 76 as actuating rod 76 moves within slot 148.

When activation pin 126 lifts ball 98 off of inlet valve seat 96 and compressed air enters the interior of pump body 12, fluid within pump body 12 is forced up through outlet port 42, through dip tube 16, through discharge port 56 and through the associated discharge line. Fluid is not allowed to exit pump body 12 other than through outlet port 42 due to the operation of air discharge valve 68 and end cap check valve 22. Fluid continues to leave pump body 12 and eventually float 18 begins to lower. As float 18 begins to move downward, air inlet valve 66 is held open and air discharge valve 68 is held closed by the magnetic attraction of magnets 140 and 64 holding activation arm 122 in an upward position. As float 18 continues to lower, float 18 will contact lower stop 74 and thus begin to exert a load on the attached magnets 140 and 64 due to the weight of float 18 reacting through actuating rod 76. When the level of fluid within pump 12 lowers to the point that the weight of float 18 supported by actuating rod 76 exceeds the load necessary to separate magnets 140 and 64, activation arm 122 pivots downward and closes air inlet valve 66 and opens air discharge valve 68. Downward movement of float 18 is limited by lower step 78 on dip tube 16. Pumping system 10 will then begin another cycle. This pump cycling will continue as long as compressed air is provided to air inlet valve 66 and fluid is present in the well surrounding pumping system 10.

Figure 6:
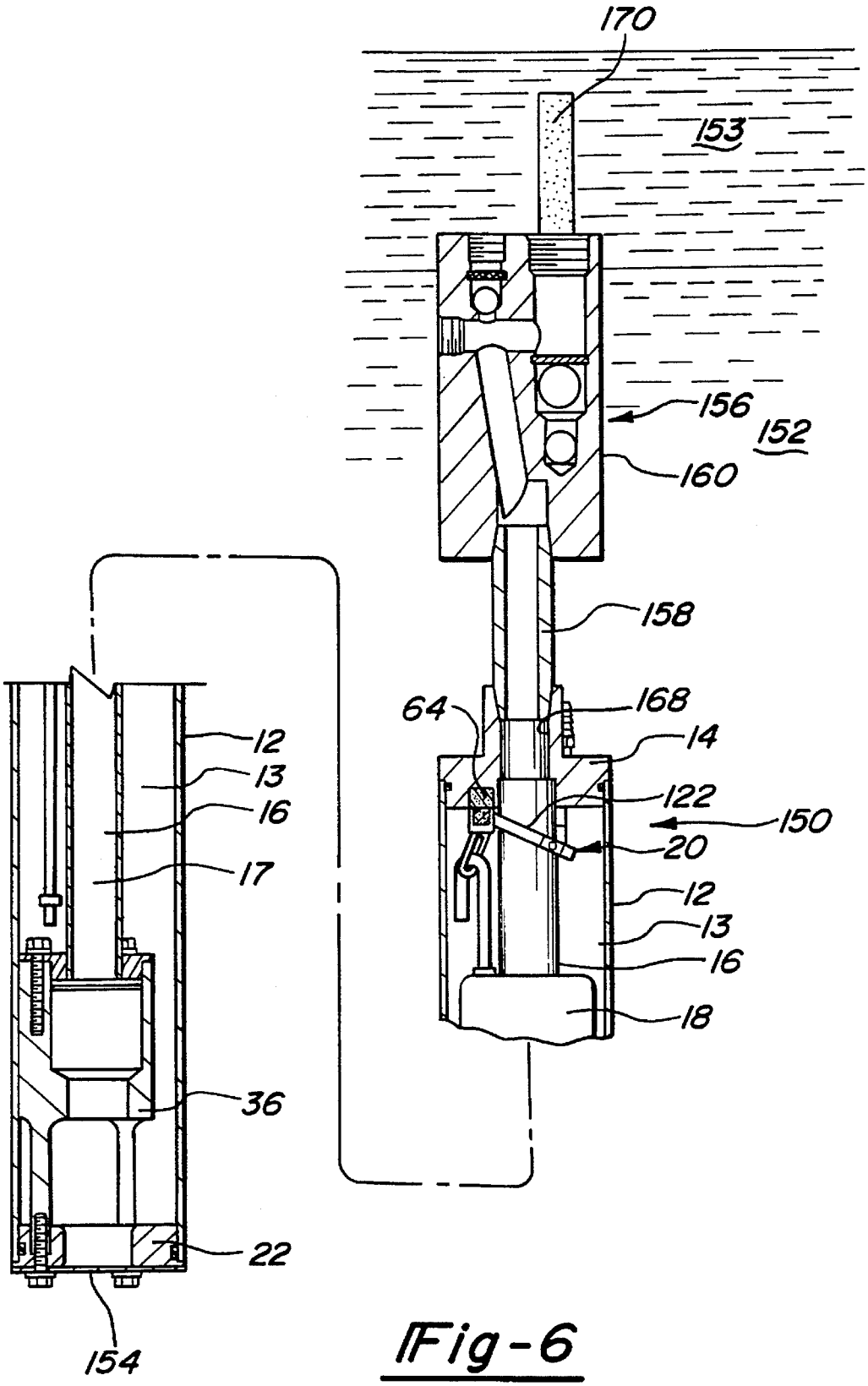
FIG. 6 is a longitudinal cross-sectional view of another pumping system according to the present invention.
Figure 7:
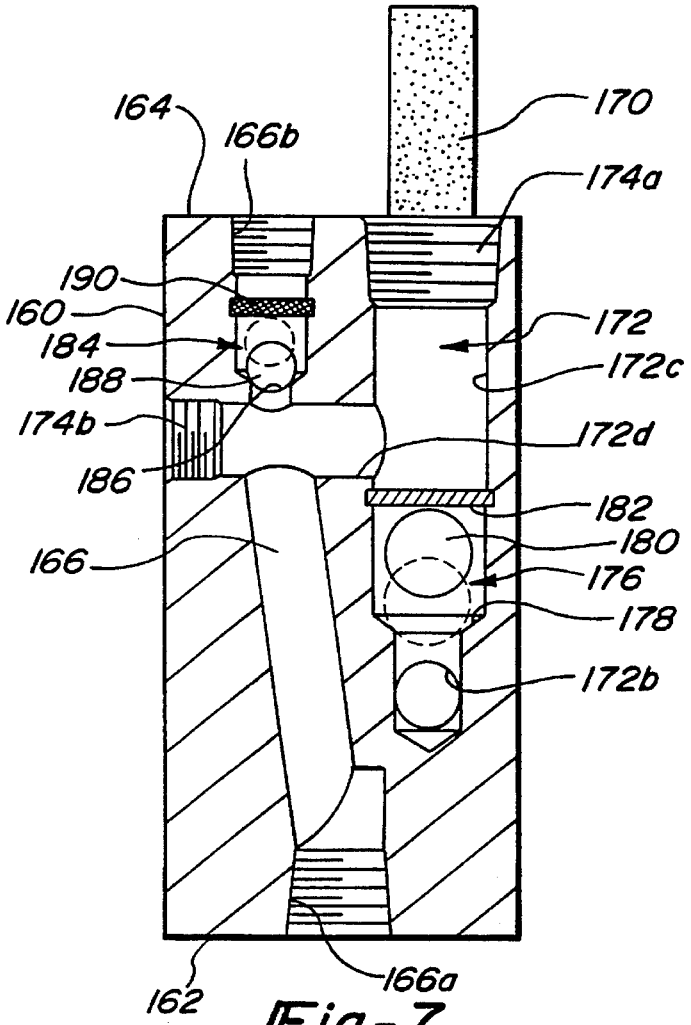
FIG. 7 is an enlarged view of a discharge check valve assembly shown in FIG. 6.
Figure 8:
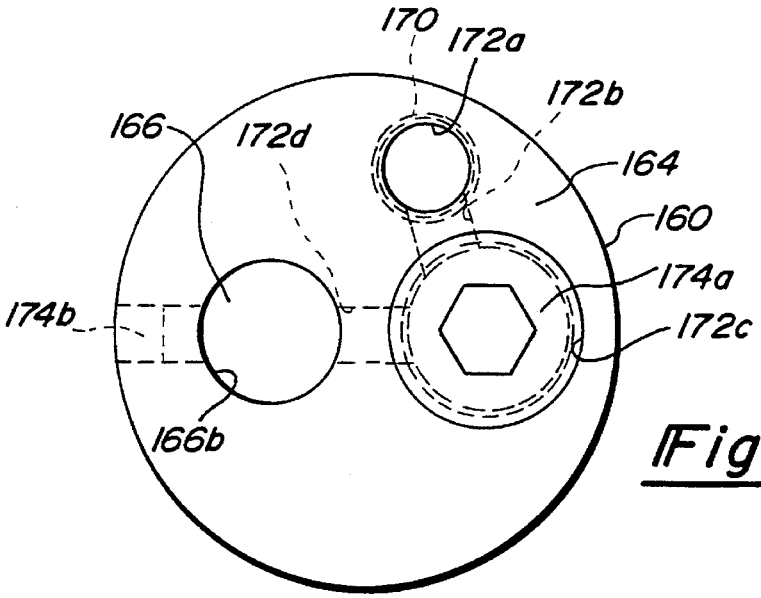
FIG. 8 is a top plan view of the discharge check valve assembly shown in FIG. 6.

A preferred embodiment of a top fill recovery unit or pumping system 150 according to this invention is shown in FIGS. 6–8. The pumping system 150 is particularly adapted for immersion into groundwater 152 below the ground and skimming a thin layer 153 of hydrocarbon, such as oil or gasoline, which are lighter than water and reside on the top of the groundwater. Because the pumping system 150 is similar to the bottom entry pumping system 10, like reference numerals will be used for like parts.

The pumping system 150 includes the pump body 12, the discharge housing 14, the dip tube 16, the float 18, and the activation mechanism 20 and 122. The discharge housing 14 is secured to the upper end of the pump body 12 and mounts the air inlet valve 66, the air discharge valve 68, and the upper end of the dip tube 16. The pump body 12 and the dip tube 16 are generally concentrically arranged whereby to form outer and inner chambers 13 and 17. Additionally, the actuation arrangement, including the activation arm 122 connected to the valves 66 and 68, the magnets 64 and 140, and the actuation rod connecting the arm with the float, is provided in the manner as discussed before.

According to this embodiment of the invention, the pump body 12 is closed at its lower end by a closure plate 154 to prevent entry of external groundwater into the chambers 13 and 17. As shown, the closure plate 154 blocks entry of external groundwater adjacent to the lower end of the pump body 12 into the area formed below the lower entrance to the dip tube 16. In the arrangement shown, and as well be described hereinafter, the check balls 32 and 46 are removed from the end cap check valve 22 and back flow check valve 36. That is, the inlet check valves 22 and 36 are not needed as such, only that a passage be provided whereby communication between the chambers 13 and 17 is provided.

According to this invention, a discharge check valve assembly 156 for transporting the hydrocarbons from the pump body via the discharge line (not shown) to a holding tank at a remote location is connected to the discharge housing 14 by a discharge conduit 158. The discharge check valve assembly 156 comprises a valve body 160 having a lower end face 162, an upper end face 164, and a discharge bore 166 extending between the end faces. The discharge bore 166 defines a threaded inlet 166a that opens onto the lower end face 162 and is connected to the upper end portion of the discharge conduit 158 and a threaded outlet 166*b* that opens onto the upper end face 164 and is connected to the discharge line. In this arrangement, the discharge line is disconnected from the outlet bore 168 of the discharge housing 14 and reconnected to the outlet 166*b* of the discharge valve assembly, and the lower end portion of the conduit is threadably connected to the outlet bore 168 in the housing 14.

An arrangement for drawing the hydrocarbons from the groundwater 152 includes a semi-permeable screen 170 which is positioned in the hydrocarbon layer 153, and an elongated passage 172, the passage extending from the screen, into the valve body 160, and into communication with the discharge bore 166. As shown, the passage 172 includes, in sequence, a first passage portion 172*a* that extends from the upper end face 164 and passes hydrocarbons received by the screen 170, a second passage portion 172*b*, a third passage portion 172*c*, and a fourth passage portion 172*d* that communicates with the discharge bore 166.

The screen 170 can, depending on the application, comprise a hydrophobic screen and pass only hydrocarbon (i.e., block groundwater), or a standard thin-mesh membrane. Each are conventional and commercially available.

The third and fourth passage portions 172*c* and 172*d* are conveniently formed by drilling a respective bore into the valve body 160 and closing the bores by plugs 174*a* and 174*b*. The third passage portion 172*c* defines, in part, a check valve 176 including a check valve seat 178 and a check ball 180 which will lift from the valve seat to allow fluid received from the screen to pass but prohibit fluid to flow back to the screen 170. The check ball 180 must lift freely but is subject to material sticking to its surfaces, possibly inhibiting smooth opening of the valve. Preferably, the check ball 180 is comprised of Teflon or other suitable material that will inhibit substances from sticking to its surface. A pervious wire retainer 182 is secured in the passage to limit movement of the check ball 180 from its unseated position but permit fluid to pass.

The discharge bore 166 includes, in part, a check valve 184 including a check valve seat 186 and a Teflon check ball 188, the check valve allowing fluid received from the fourth passage portion 172*d* to be discharged from the valve body 160 via the outlet 166*b*. A pervious wire retainer 190 is secured in the passage to limit movement of the check ball 188 from its unseated position but permit fluid to pass.

In operation, the pumping system 150 is positioned in the groundwater with its screen 170 protruding into the hydrocarbon to be skimmed. Initially, the air inlet valve 66 is closed and the air discharge valve is open to atmosphere. Fluid from the hydrocarbon layer enters the valve body 160 through the screen 170, passes through the passage portions 172*a*, 172*b* and 172*c*, causing the check ball 180 to rise, through the retainer screen 182 and downwardly through the discharge bore, through the inlet 166*a* and the discharge conduit 158, and into the pump body 12. This filling operation continues, causing the chamber 13 to fill and the float 18 to rise.

Thereafter, as described above, the float 18 will engage and cause the activation arm 122 to pivot, the check ball 118 will close the discharge valve 68, and the check ball 98 will lift from its valve seat 96 whereby to admit compressed air into the chamber 13 of the pump body 12. The hydrocarbon fluid in the pump body 12 is forced downwardly in chamber 13, into the chamber 17, up through the dip tube 16, through the discharge conduit 158, through the discharge bore 166, and through the discharge outlet 166*b*. The hydrocarbon fluid is expelled from the body 12, causing the chamber 13 to empty, the float 18 to be lowered resulting in the activation arm 122 pivoting downwardly, the air inlet valve 66 being closed, and the air discharge valve 68 being opened. The pumping system 150 will then begin another cycle, the pump cycling continuing as long as compressed air is provided to air inlet valve 66 and fluid is present in the well surrounding the pumping system.

The top fill recovery unit 150 is easily modified to the bottom fill underground contaminated water recovery unit, such as shown by the pumping system 10, by removing the closure plate 154, replacing the check balls 32 and 46 in the inlet check valves 22 and 38 arranged at the lower end portion, removing the top discharge check valve assembly 156, and connecting the return line directly to the top of the assembly. As such, the user can purchase a set, comprising the basic tubular housing, and each of the specific elements needed to assemble the top fill and the bottom fill units.

While the above detailed description describes the preferred embodiment of the present invention, it should be understood that the present invention is susceptible to modification, variation and alteration without deviating from the scope and fair meaning of the subjoined claims.

What is claimed is:

1. A pump for directing liquid out of a well, said pump comprising:

a pump housing having a closed upper end and a closed lower end, said pump housing defining at least one interior chamber;

means for defining a pump refill mode and a pump discharge mode disposed within said interior chamber; and a discharge valve connected to said upper end of said pump housing for selectively permitting said liquid to enter said interior chamber in said pump refill mode and permitting said liquid to be discharged from said interior chamber in said pump discharge mode.

2. The pump according to claim 1 wherein, said discharge valve comprises a refill check valve for permitting said liquid to flow to said interior chamber in said pump refill mode and preventing said liquid from flowing from said interior chamber in said pump discharge mode.

3. The pump according to claim 2 wherein, said discharge valve comprises a discharge check valve for permitting said liquid to flow from said interior chamber in said pump discharge mode and preventing liquid from flowing into said internal chamber in said pump refill mode.

4. The pump according to claim 3 wherein, said pump further comprises an inlet valve for supplying compressed gas to said interior chamber in said discharge mode whereby to force said liquid from said interior chamber through said discharge valve and depressurizing said interior chamber in said refill mode whereby to allow said liquid to flow into said interior chamber through said discharge valve.

5. The pump according to claim 2 wherein, said discharge valve comprises a discharge check valve for permitting said liquid to flow from said interior chamber in said pump discharge mode and preventing liquid from flowing into said internal chamber in said pump refill mode.

6. The pump according to claim 5 wherein, said pump further comprises an inlet valve for supplying compressed gas to said interior chamber in said discharge mode whereby to force said liquid from said interior chamber through said discharge valve and depressurizing said interior chamber in said refill mode whereby to allow said liquid to flow into said interior chamber through said discharge valve.

7. The pump according to claim 1 wherein, said discharge valve comprises a discharge check valve for permitting said liquid to flow from said interior chamber in said pump discharge mode and preventing liquid from flowing into said internal chamber in said pump refill mode.

8. The pump according to claim 7 wherein, said pump further comprises an inlet valve for supplying compressed gas to said interior chamber in said discharge mode whereby to force said liquid from said interior chamber through said discharge valve and depressurizing said interior chamber in said refill mode whereby to allow said liquid to flow into said interior chamber through said discharge valve.

9. The pump according to claim 1 wherein, said pump further comprises an inlet valve for supplying compressed gas to said interior chamber in said discharge mode whereby to force said liquid from said interior chamber through said discharge valve and depressurizing said interior chamber in said refill mode whereby to allow said liquid to flow into said interior chamber through said discharge valve.

10. The pump according to claim 14 wherein, said pump further comprises a semi-permeable screen connected to said discharge valve for forming an inlet to said interior chamber.

11. The pump according to claim 10 wherein, said screen is pervious to liquid hydrocarbons and impervious to ground water.

12. A pump for directing liquid out of a well, said pump comprising:

a pump housing having a closed upper end and a closed lower end, said pump housing defining interconnected first and second interior chambers;

a float mounted in said first interior chamber for movement between a first position adjacent said lower end of said housing and a second position adjacent said upper end of said housing, said float defining a pump refill mode at said first position and a pump discharge mode at said second position; and a discharge valve connected to said upper end of said housing for selectively permitting said liquid to enter said first interior chamber in said pump refill mode and permitting said liquid to be discharged from said first interior chamber in said pump discharge mode.

13. The pump according to claim 12 wherein, said discharge valve comprises a refill check valve for permitting said liquid to flow to said interior chamber in said pump refill mode and preventing said liquid from flowing from said interior chamber in said pump discharge mode.

14. The pump according to claim 12 wherein, said discharge valve comprises a discharge check valve for permitting said liquid to flow from said interior chamber in said pump discharge mode and preventing liquid from flowing into said internal chamber in said pump refill mode.

15. The pump according to claim 14 wherein, said pump further comprises an inlet valve for supplying compressed gas to said interior chamber in said discharge mode whereby to force said liquid from said interior chamber through said discharge valve and depressurizing said interior chamber in said refill mode whereby to allow said liquid to flow into said interior chamber through said discharge valve.

16. The pump according to claim 12 wherein, said pump further comprises an inlet valve for supplying compressed gas to said interior chamber in said discharge mode whereby to force said liquid from said interior chamber through said discharge valve and depressurizing said interior chamber in said refill mode whereby to allow said liquid to flow into said interior chamber through said discharge valve.

17. The pump according to claim 12 wherein, said pump further comprises a semi-permeable screen connected to said discharge valve for forming an inlet to said interior chamber.

18. The pump according to claim 17 wherein, said screen is pervious to liquid hydrocarbons and impervious to ground water.

* * * * *